US006686897B2

(12) United States Patent
Huang et al.

(10) Patent No.: US 6,686,897 B2
(45) Date of Patent: Feb. 3, 2004

(54) PLASMA DISPLAY PANEL AND METHOD OF DRIVING THE SAME

(75) Inventors: Jih Fon Huang, Hsinchu Hsien (TW); Shin-Tai Lo, Miaoli Hsien (TW)

(73) Assignee: AU Optronics Corp., Hsinchu (TW)

( * ) Notice: Subject to any disclaimer, the term of this patent is extended or adjusted under 35 U.S.C. 154(b) by 41 days.

(21) Appl. No.: 10/010,520

(22) Filed: Nov. 12, 2001

(65) Prior Publication Data

US 2002/0130824 A1 Sep. 19, 2002

Related U.S. Application Data

(63) Continuation-in-part of application No. 09/810,360, filed on Mar. 16, 2001.

(30) Foreign Application Priority Data

Nov. 21, 2000 (TW) ..... 89119450 A

(51) Int. Cl.[7] ..... G09G 3/28

(52) U.S. Cl. ..... 345/66; 345/60; 315/169.1; 315/169.2; 313/581; 313/582

(58) Field of Search ..... 345/60–68; 315/169.1, 315/169.2, 169.4; 313/581, 582, 584, 590

(56) References Cited

U.S. PATENT DOCUMENTS

| | | | | | |
|---|---|---|---|---|---|
| 6,084,559 | A | * | 7/2000 | Nagao et al. | 345/67 |
| 6,124,676 | A | * | 9/2000 | Salavin et al. | 315/169.4 |
| 6,160,529 | A | * | 12/2000 | Asao et al. | 345/60 |
| 6,184,848 | B1 | * | 2/2001 | Weber | 345/60 |
| 6,295,040 | B1 | * | 9/2001 | Nhan et al. | 345/60 |

* cited by examiner

*Primary Examiner*—Richard Hjerpe
*Assistant Examiner*—Henry N. Tran
(74) *Attorney, Agent, or Firm*—Ladas & Parry

(57) ABSTRACT

A plasma display panel having scanning electrodes (Y) and sustaining electrodes (X) arranged in the form of XX-YY-XX-YY . . . , a rib structure vertically crossing the scanning electrodes (Y) and sustaining electrodes (X). The priming discharges during reset period does not occur in the display areas of the plasma display panel, the picture quality is assured from avoiding the emission of over-brightness in the reset period which enables the sequential gaseous discharge operations to proceed with smaller driving voltage.

9 Claims, 4 Drawing Sheets

PLASMA DISPLAY PANEL AND METHOD OF DRIVING THE SAME

CROSS REFERENCE TO RELATED APPLICATION

This application is a continuation-in-part of U.S. patent application Ser. No. 09/810,360 filed Mar. 16, 2001, which is hereby incorporated by reference.

BACKGROUND OF THE INVENTION

1. Field of the Invention

The present invention generally relates to a plasma display panel (hereinafter referred to as PDP) and a method of driving the PDP. More specifically, the method and apparatus of the present invention can reduce the back-glow phenomena caused by the discharge operation during the reset period for a PDP, therefore, enhancing the contrast of the plasma display panel The present invention generally relates to a plasma display panel (hereinafter referred to as PDP). More specifically, it relates to a plasma panel can reduce the back-glow phenomena caused by the discharge operation during the reset period, therefore, enhancing the contrast of the plasma display panel.

2. Description of the Related Art

Plasma display is one of most promising flat panel display technologies because it can provide a large and flat display screen and can display full-color images. The basic theory and operation of a PDP is described below.

FIG. 1 is a cross-sectional view of a conventional PDP cell constructed by two glass substrates 1 and 7 and the components formed thereon. Inert gases, such as Ne and Xe, are filled in the cavity between the glass substrates 1 and 7. The components formed on the glass substrate 1 include sustaining electrodes X, scanning electrodes Yi, a dielectric layer 3 and a protective film 5. The components formed on the glass substrate 7 include address electrodes Aj and the fluorescent material 9 formed thereon. The rib 8 (generally which is parallel to the scanning electrodes Yi and the sustaining electrodes X) is formed on the peripheral of each PDP cell to isolate the PDP cell. Therefore, each PDP cell 10 includes three kinds of electrodes, i.e., the sustaining electrode X and the scanning electrode Yi, which is parallel to each other, and the address electrodes Aj crossing vertically the sustaining electrode X and the scanning electrode Yi.

FIG. 2 is a block diagram illustrating a plasma display formed by the PDP cells shown in FIG. 1. As shown in the drawing, the PDP 100 is driven by the scanning electrodes Y1~Yn, the sustaining electrodes X and the address electrodes A1~Ap. The position of the cell 10 is as shown in the drawing. Each cell is isolated by the rib 8 as shown in FIG. 1. Furthermore, the plasma display includes the control circuit 110, the Y scanning driver 112, the X sustaining driver 114 and the address driver 116. The control circuit 110 generates timing signals for the drivers according to the external clock signal CLOCK, the data signal DATA, the vertical synchronous signal VSYNC and the horizontal synchronous signal HSYNC, wherein the clock signal CLOCK represents the data transmittal clock, the data signal DATA represents the display data, and the vertical synchronous signal VSYNC and the horizontal synchronous signal HSYNC are respectively used to define the timing sequences of a frame and a scanning line. The control circuit 110 sends the display data and the clock signal to the address driver 116 and sends the corresponding frame control clock to the Y scanning driver 112 and the sustaining driver 114. The display data is sequentially transmitted to the address driver 116 by the control circuit 110 and wall charges are built to selected cell by the address discharges. Address discharges are caused by the data pulses of address electrodes A1~Ap and the scanning pulses of scanning electrodes Y1~Yn which are sequentially sent by the Y scanning driver 112. The detailed operation and the control signals for the electrodes are described below.

FIG. 3 is a diagram illustrating the manner to drive a conventional PDP to display a frame. As shown in the drawing, each frame is divided into eight sub-fields SF1~SF8. Each sub-field includes three operating period, that is, the reset period R1~R8, the address period A1~A8 and the sustain period S1~S8. In the reset period, the residual charges of the former sub-field are cleared to make the initial conditions of all cells before the address period almost the same. In the address period, the address discharges are initiated in the selected cells according to the display data and then wall charges are accumulated. In the sustain period, sustain discharges for displaying are repeatedly initiated and visible light can be produced in the cells which have accumulated charges through the address discharge in the address period. All of the PDP cells are processed at the same time during the reset period R1~R8 and the sustain period S1~S8. The address operation is sequentially performed for each cell on the scanning electrodes Y1~Yn during the address period A1~A8. Moreover, the display brightness is proportional to the length of the sustain period S1~S8. In the example of FIG. 3, the length of the sustain periods S1~S8 of the sub-fields SF1~SF8 can be set in a ratio of 1:2:4:8:16:32:64:128 to display images in 256 gray scales.

FIG. 4 is a timing diagram of the voltage waveforms on the electrodes in a single sub-field of the prior art. The voltage waveforms on the address electrodes Aj are generated by the address driver 116, the voltage waveforms on the sustaining electrodes X are generated by the X sustaining driver 114, and the voltage waveforms on the scanning electrodes Y1~Yn are generated by the Y scanning driver 112. As shown in the drawing, each sub-field includes the reset period, the address period and the sustain period. The voltage waveforms in each period and the resulted manners are described in detail below.

At the time point a (in FIG. 4) of the reset period, the voltage of the scanning electrodes Y1~n is set to 0 V, and a write pulse having a voltage of VS+VW is applied to the sustaining electrode X, in which the voltage VS+VW is larger than the firing voltage between the sustaining electrode X and the scanning electrode Yi. Therefore, the global writing discharge W occurs between the sustaining electrode X and the scanning electrodes Yi. This discharge process accumulates negative charges on the sustaining electrode X and positive charges on the scanning electrodes Yi. The electric field produced by the accumulated negative charges and the positive charges will cancel out the voltage difference between the sustaining electrodes, thus the time of global writing discharge W is very short.

At the time point b, the sustaining electrode X is set to 0 V, and a sustaining pulse 202 having a voltage of VS is applied to all of the scanning electrodes Y1~Yn, wherein the value of the voltage VS plus the voltage caused by the charges accumulated between the sustaining electrodes must be larger than the firing voltage between the scanning electrodes Yi and the sustaining electrode X. Thus, the global sustaining discharge S occurs between the sustaining electrode X and the scanning electrodes Yi. Different from the previous discharge process, this discharge process accumulates positive charges on the sustaining electrode X and negative charges on the scanning electrodes Yi.

At the time point c, the scanning electrode Yi is set to 0 V, an erase pulse 203 having a voltage lower than VS is applied to the sustaining electrode X, and an address pulse having a voltage of −VS can be applied to the address electrode Aj. The erase pulse is used to neutralize a part of the charges. On the scanning electrodes Y1~Yn, required wall charges are left so that the write operation can proceed with a lower voltage in the sequential address period.

In the address period, the voltage of the sustaining electrode X and the scanning electrodes Yi are pulled up to VS at the time point d. Then a scan pulse 204 is sequentially applied to the scanning electrodes Y1~Yn from the time point e, and an address pulse having a voltage of VA is applied to the address electrode Aj at the same time. When a cell of a scanning line turns ON, the write discharge occurs, that is, the corresponding display data is written into the cell.

After scanning all of the scanning electrodes Y1~Yn, the sustain period begins. The sustaining electrode X and the scanning electrode Yi are first set to 0 V. Then the sustaining pulses 205 having the same voltage are applied to the sustaining electrode X and the scanning electrodes Yi in an alternate way, i.e., at the time point f and at the time point g. Thus, the cell with the data ON during the address period will irradiate. It should be noted that the waveform of driving signals described above is only an example. The waveform varies in practice, but the same theory is applied.

As described above, the length of the sustain period is proportional to the displayed brightness. Assume that a frame includes 510 sustain periods, in which each sustaining discharge period has two periods of discharge. The number of sustain periods for the sub-fields SF1~SF8 can be 2, 4, 8, 16, 32, 64, 128, and 256, respectively. Therefore, there are 1020 periods of discharge of the sustain period during the display period of a frame. This discharge operation enables a PDP device to display images.

On the other hand, 2 to 3 discharges, such as global writing discharge, global sustaining discharge and erase discharge, are performed during the reset period to uniformly distribute the wall charges. The discharges during the reset period can also make the PDP device irradiate with a brightness brighter than that produced by the discharge during the sustain period. Roughly speaking, the brightness produced by three periods of discharge during the reset period is about the brightness by five periods of discharge during the sustain period. The ratio of the highest brightness and the lowest brightness for the PDP device is about $1020:(5\times8)\cong26:1$, in which 1 corresponds to the brightness of black. Therefore, the brightness produced by the discharge during the reset period should be as low as possible in order to improve the image quality of black, which is an important factor for displaying images. It is thus a significant issue to reduce the brightness produced by the discharge during the reset period.

In U.S. patent application Ser. No. 09/810,360 filed Mar. 16, 2001, two novel driving methods have been disclosed to solve the above issue. Associated with one of the driving methods in the cross-referenced application, a novel plasma display panel, is further disclosed in this invention.

SUMMARY OF THE INVENTION

Therefore, an object of the present invention is to provide a plasma display panel, which comprises a first substrate and a second substrate supported in spaced relationship to define a discharge space (or discharge cavity) therebetween, the first and second substrates having opposed surfaces facing each other across the discharge space; a plurality of scanning electrodes ($Y_1$~$Y_n$) and a plurality of sustaining electrodes ($X_1$~$X_m$) formed on the first substrate, wherein every two of the scanning electrode pairs ($Y_a$, $Y_{a+1}$) and every two of the sustaining electrode pairs ($X_b$, $X_{b+1}$) are alternately arranged on the first substrate, one of the scanning electrodes (for example, $Y_{a+1}$) and adjacent one of the sustaining electrodes (for example, $X_b$) define a display discharge cell, every two of the scanning electrodes ($Y_a$, $Y_{a+1}$) and every two of the sustaining electrodes ($X_b$, $X_{b+1}$) respectively define priming discharge cells; a plurality of address electrodes formed on the second substrate, perpendicular to the scanning and sustaining electrodes; and a stripe rib structure separating the discharge space into a plurality of stripe discharge regions, substantially parallel to the address electrodes.

Another object of the present invention is to provide a driving method of plasma display panels, wherein, a plurality of sustaining electrodes ($X_1$~$X_m$) and a plurality of scanning electrodes ($Y_1$~$Y_n$), configured in a sequence as $X_1$-$X_2$-$Y_1$-$Y_2$-$X_3$-$X_4$ . . . $X_{m-1}$-$X_m$-$Y_{n-1}$-$Y_n$, and a plurality of address electrodes perpendicularly crossed over the sustaining electrodes and scanning electrodes; wherein, the dark areas $XG_k$ are defined between the sustaining electrodes $X_{2k-1}$ and the sustaining electrodes $X_{2k}$, and the dark areas $YG_k$ are defined between the scanning electrodes $Y_{2k}$ and the scanning electrodes $Y_{2k-1}$. And the display areas $D_{2k-1}$, are defined between the sustaining electrodes $X_{2k}$ and the scanning electrodes $Y_{2k-1}$, and the display areas $D_{2k}$ are defined between the scanning electrodes $Y_{2k}$ and the sustaining electrodes $X_{2k+1}$ (n, m and j are integers, and $1\leqq j\leqq n$ and m). Wherein, at the first timing point in the reset period, apply a global writing voltage difference $V_w$ to the dark areas $XG_k$ and $YG_k$, but there is no voltage difference in the display areas $D_{2k-1}$ and $D_{2k}$. The global writing voltage difference is greater than the firing voltage between the adjacent pairs of the sustaining electrodes $X_{2k-1}$ and $X_{2k}$, and the adjacent pairs of the scanning electrodes $Y_{2k-1}$ and $Y_{2k}$; whereby, the gas discharges are occurred in the dark areas $XG_k$ and $YG_k$ for the generation of space charges and wall charges, but do not proceed with the discharge operation in the display areas $D_{2k-1}$ and $D_{2k}$.

These and further features, aspects and advantages of the present invention, as well as the structure and operation of various embodiments thereof, will become readily apparent with reference to the following detailed description of a presently preferred, but nonetheless illustrative embodiment when read in conjunction with the accompanying drawings, in which like reference numbers indicate identical or functionally similar elements throughout the enumerated Figures.

BRIEF DESCRIPTION OF THE DRAWINGS

The drawings referred to herein will be understood as not being drawn to scale except if specially noted, the emphasis instead being placed upon illustrating the principles of the present invention. In the accompanying drawings.

DETAILED DESCRIPTION OF THE PREFERRED EMBODIMENTS

Reference is now made in detail to an embodiment of the present invention that illustrates the best mode presently contemplated by the inventor(s) for practicing the present invention. Other embodiments are also described herein.

Figure 1:
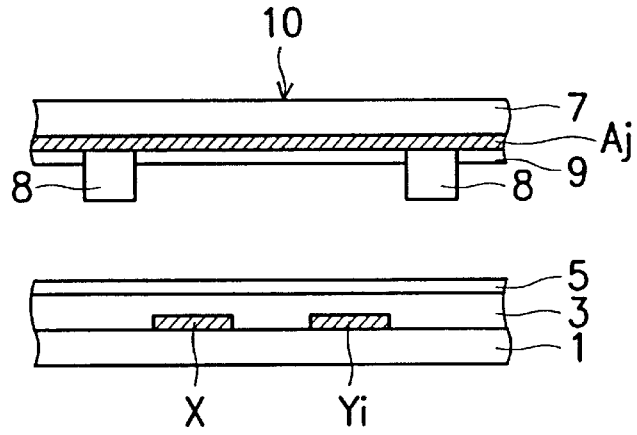
FIG. 1 ( PRIOR ART )
FIG. 1 represents the side view of the dissection graph of the cells in a conventional PDP.
Figure 2:
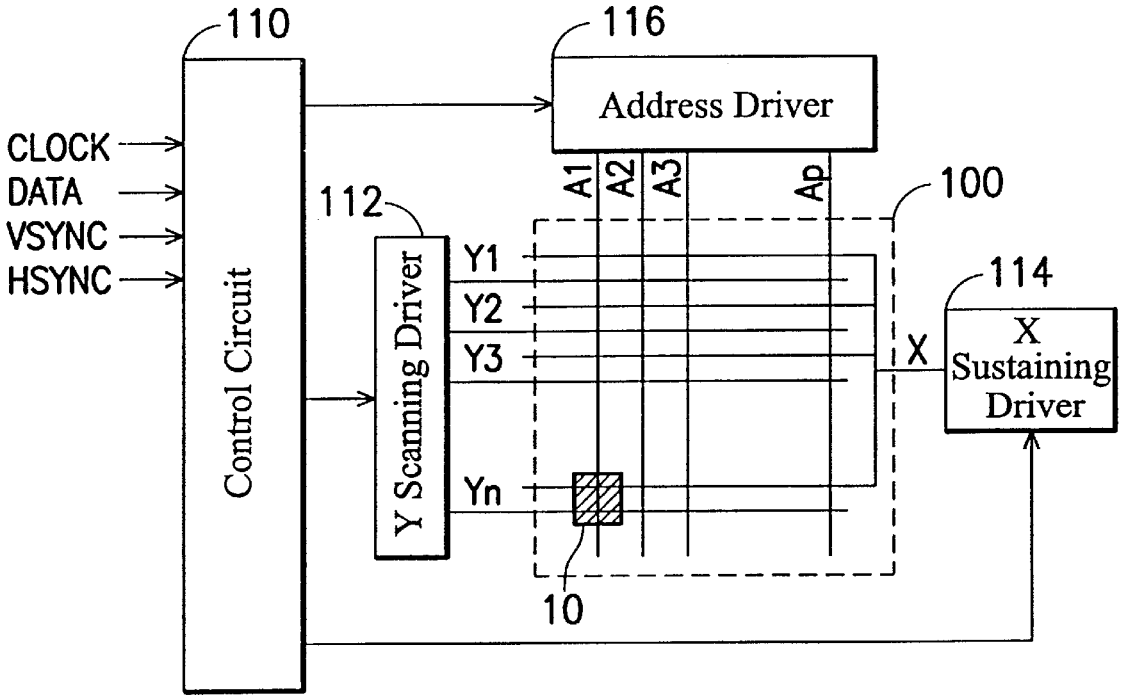
FIG. 2 ( PRIOR ART )
FIG. 2 represents the block diagram of the PDP device comprised of the PDP in FIG. 1.
Figure 3:
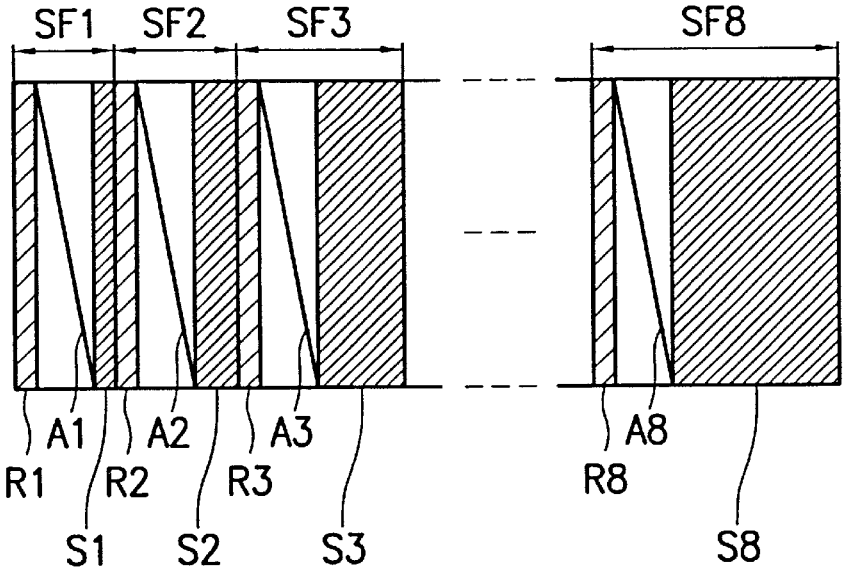
FIG. 3 ( PRIOR ART )
FIG. 3 represents the schematic diagram of the conventional PDP in a display mode.
Figure 4:
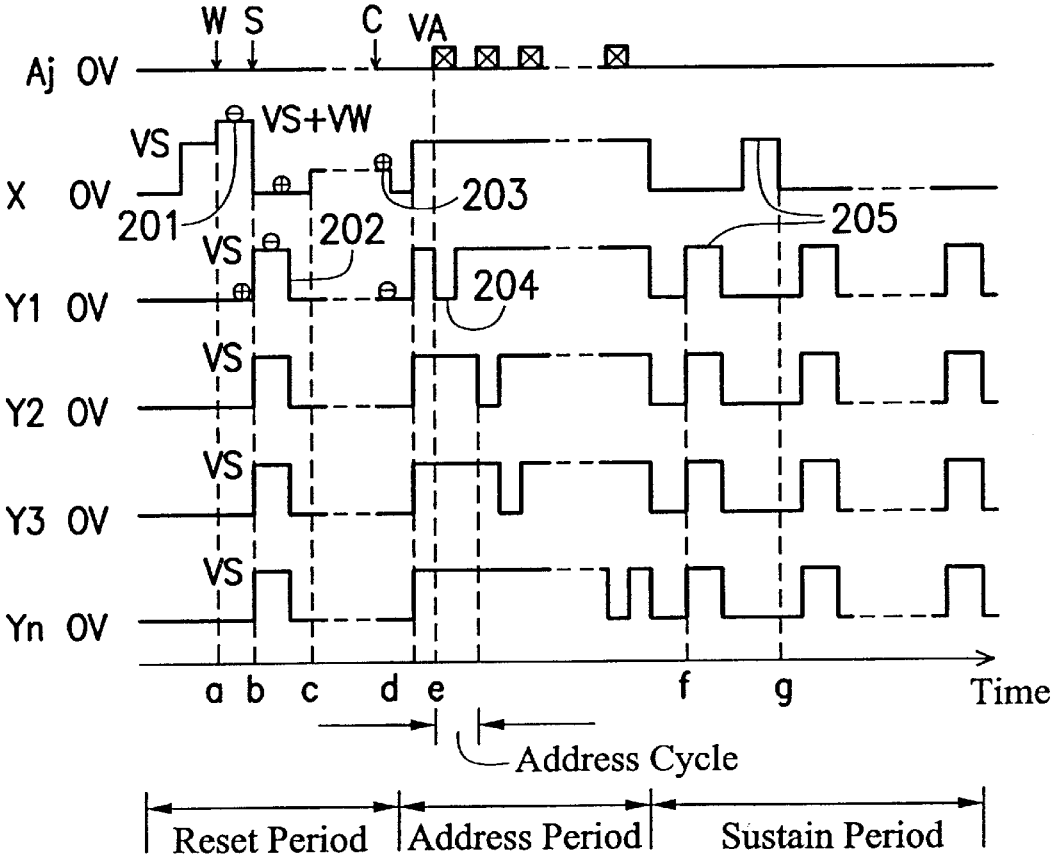
FIG. 4 ( PRIOR ART )
FIG. 4 is a timing diagram of the control signals for the electrodes including the address electrodes Ai, the sustaining electrodes X and the scanning electrodes Yi in a single sub-field according to the prior art.
Figure 5:
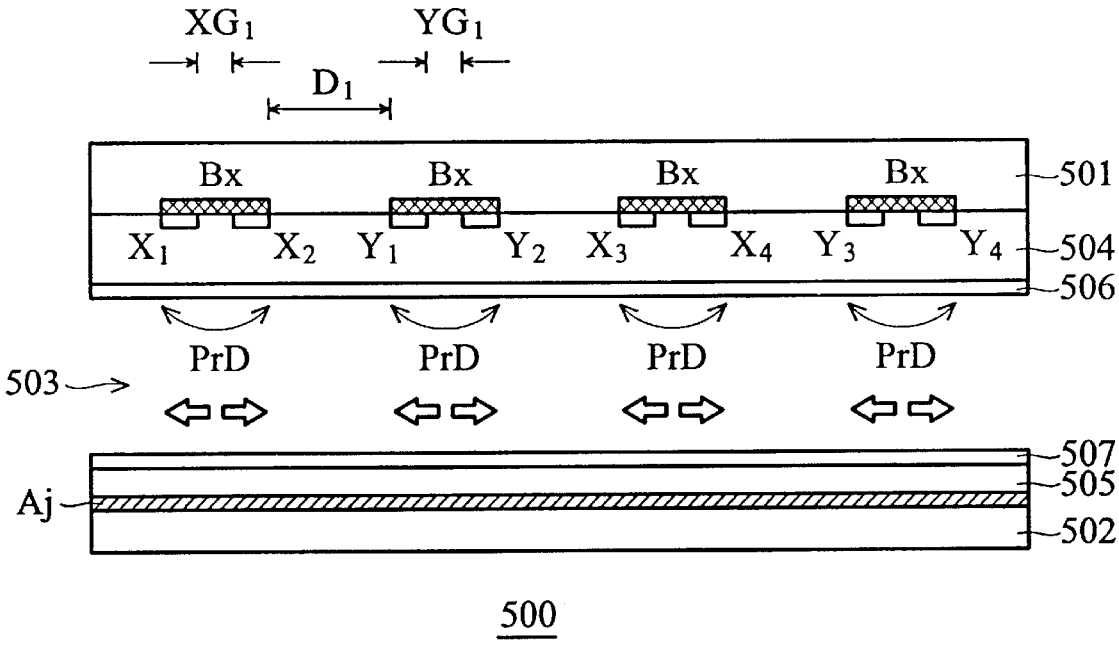
FIG. 5 is an embodiment of the PDP according to the present invention.

FIG. 5 shows an embodiment of the PDP according to the present invention. The PDP 500 comprises a first substrate 501 and a second substrate 502 supported in spaced relationship to define a discharge space 503 therebetween, the first and second substrates (501, 502) having opposed surfaces facing each other across the discharge space 503; a plurality of scanning electrodes ($Y_1$~$Y_n$) and a plurality of sustaining electrodes ($X_1$~$X_m$) formed on the first substrate 501, wherein every two of the scanning electrodes (for example, $Y_1$-$Y_2$, $Y_3$-$Y_4$, . . . ) and every two of the sustaining electrodes (for example $X_1$-$X_2$, $X_3$-$X_4$, . . . ) are alternately arranged on the first substrate, as depicted in FIG. 5; a plurality of address electrodes $A_j$ formed on the second substrate 502, perpendicularly crossing the scanning and sustaining electrodes; and a stripe rib structure, not shown in FIG. 5, separating the discharge space 503 into a plurality of stripe discharge regions, substantially parallel to the address electrodes $A_j$. For the purpose of illustration and brevity, the PDP in FIG. 5 has adopted the configuration of 4 sustaining electrodes ($X_1$~$X_4$) and 4 scanning electrodes ($Y_1$~$Y_4$) as the example.

It is noted that one of the scanning electrodes and adjacent one of the sustaining electrodes define a display discharge cell, every two of the scanning electrodes and every two of the sustaining electrodes respectively define a priming discharge cell. For example, $X_2$-$Y_1$, $Y_2$-$X_3$ and $X_4$-$Y_3$ define 3 display discharge cells, and $X_1$-$X_2$, $Y_1$-$Y_2$, $X_3$-$X_4$ and $Y_3$-$Y_4$ define 4 priming discharge cells.

Furthermore, the spaced region between every two of the scanning electrodes and every two of the sustaining electrodes are narrower than that between one of the scanning electrodes and adjacent one of the sustaining electrodes. For example, $XG_1$ and $YG_1$ are narrower than $D_1$ in FIG. 5. The PDP 500 further comprises a shadowing mask $B_X$ (for example a black matrix), formed on the first substrate 501, covering each of the priming discharge cell. Dielectric layers 504 and 505 are respectively formed on the first and second substrates (501, 502), covering the electrodes. A protective layer 506 (for example, a MgO layer) is formed over the dielectric layer 504, and a fluorescent layer (for example, a phosphor layer) 507 is formed over the second substrate 502.

Figure 6:
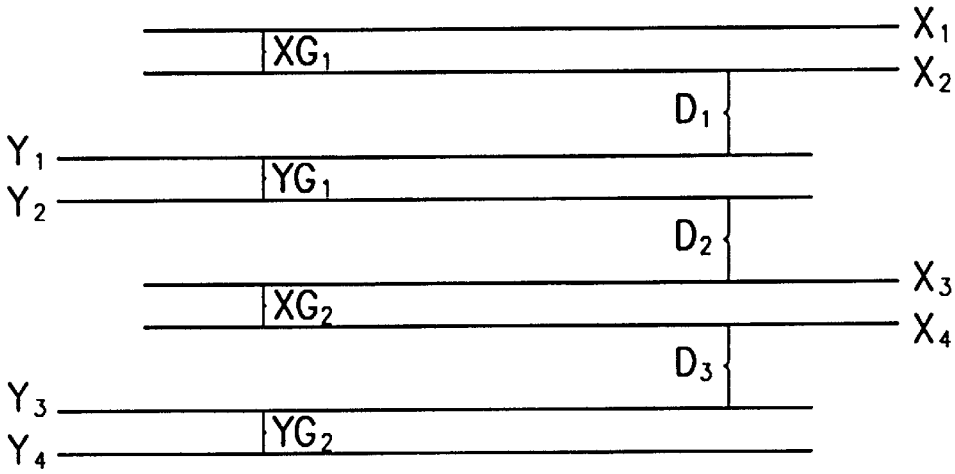
FIG. 6 is a schematic diagram of the sustaining electrodes and the scanning electrodes on the PDP of the present invention, with an electrode structure of XX-YY-XX-YY.

FIG. 6 is a schematic diagram of the sustaining electrodes and the scanning electrodes on the PDP in FIG. 5. In FIG. 6, the PDP herein includes a plurality of sustaining electrodes ($X_1$~$X_4$) and scanning electrodes ($Y_1$~$Y_4$) configured in parallel in the following manner: $X_1X_2$-$Y_1Y_2$–$X_3X_4$-$Y_3Y_4$.

The spaced region between any of the scanning electrode pairs described: $Y_1$-$Y_2$ and $Y_3$-$Y_4$ along with the spaced region between the sustaining electrode pairs described: $X_1$-$X_2$ and $X_3$-$X_4$ are defined as the dark areas $YG_1$, YG2, $XG_1$ and $XG_2$. The spaced region between the sustaining electrodes $Y_j$ and $X_{j+1}$ is defined as the display areas $D_j$ ($j \leqq 3$). It is noted that the dark areas correspond to the priming discharge cells and the display areas correspond to the display discharge cells.

Figure 7:
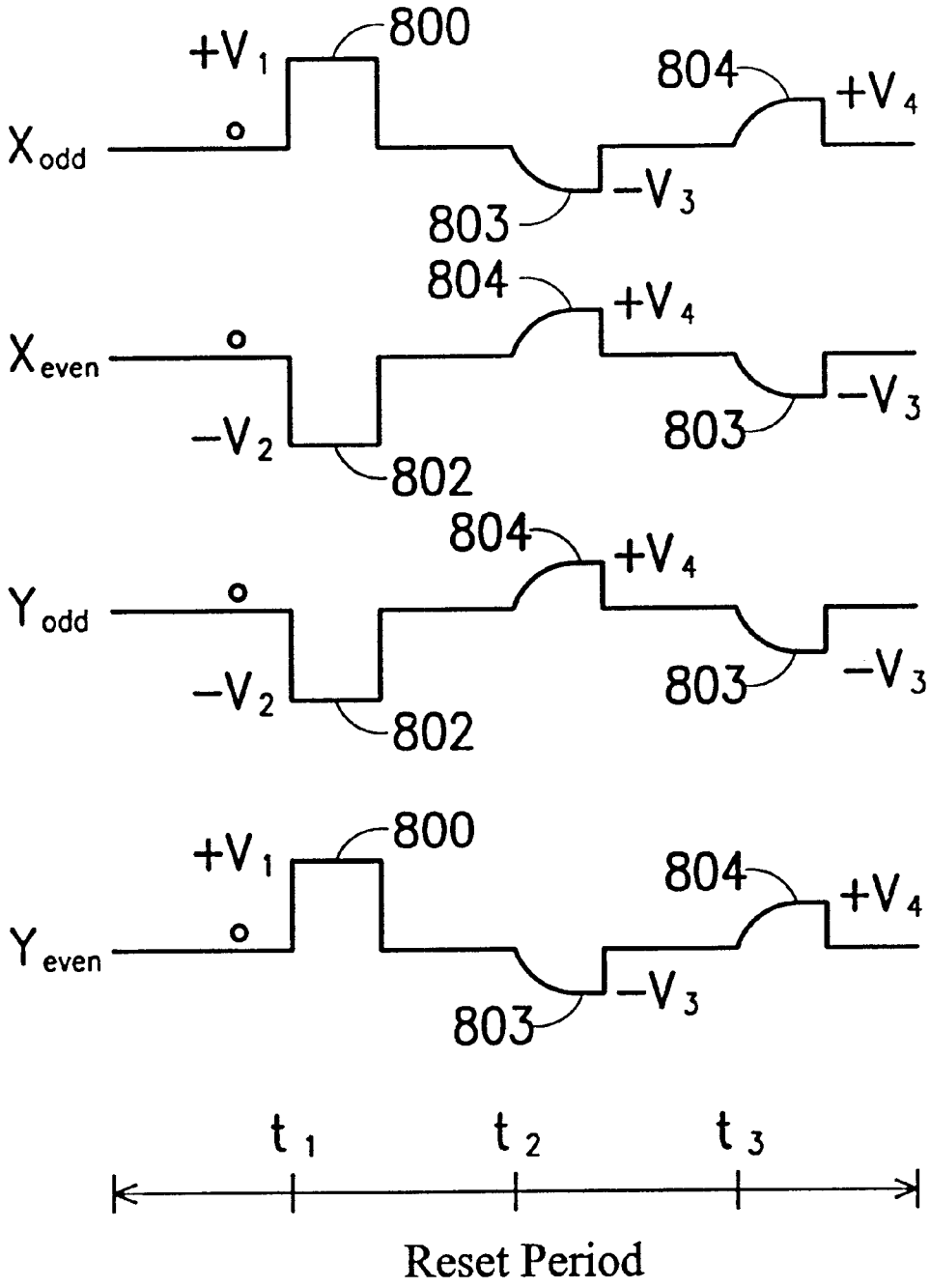
FIG. 7 is a timing diagram of the control signal on the sustaining electrodes and scanning electrodes in the reset period of the sub-field, when driving the PDP of the present invention.

FIG. 7 is a timing diagram of the control signal on each electrode (including both the odd sustaining electrodes $X_{odd}$ and the even sustaining electrode $X_{even}$ of the sustaining electrodes $X_1$~$X_4$ and the odd scanning electrodes $Y_{odd}$ and the even scanning electrodes $Y_{even}$ of the scanning electrodes $Y_1$~$Y_4$) in the reset period the sub-field of the embodiment of the present invention.

As illustrated in FIG. 7, at the first timing point $t_1$ of the reset period, a first driving signal 800 is sent to the odd sustaining electrodes $X_{odd}$ of the sustaining electrodes $X_j$ and the even scanning electrodes $Y_{even}$ of the scanning electrodes $Y_j$, and a second driving signal 802 is sent to the odd scanning electrodes $Y_{odd}$ of the scanning electrodes $Y_j$ and the even sustaining electrodes $X_{even}$ to the sustaining electrodes $X_j$. As the result of the applications hereof, a global writing voltage difference $V_w(=V_1+V_2)$ is applied on the sustaining electrode pairs $X_1$-$X_2$ and $X_3$-$X_4$, and scanning electrode pairs $Y_1$-$Y_2$ and $Y_3$-$Y_4$. But no such voltage difference is applied to the X–Y electrode pairs $X_2$-$Y_1$, $Y_2$-$X_3$ and $X_4$-$Y_3$.

In the embodiment, the first driving signal 800 is +180 volts ($V_1$=180), and the second driving signal 802 is −180 volts ($-V_2$=−180). Hence, there is a global writing voltage difference $V_w$ of 360 volts between the sustaining electrode pairs $X_1$-$X_2$ and $X_3$-$X_4$, and the scanning electrode pairs $Y_1$-$Y_2$ and $Y_3$-$Y_4$. Because the global writing voltage difference $V_w$ is greater than the firing voltage between the scanning electrode pairs and the sustaining electrode pairs described above, the sustaining electrode pairs $X_1$-$X_2$, $X_3$-$X_4$ and scan electrode pairs $Y_1$-$Y_2$, $Y_3$-$Y_4$ will proceed with the discharge operations in the dark areas $XG_1$, $XG_2$, $YG_1$ and $YG_2$ and accumulate wall charges.

In addition, the voltage difference between each electrode pairs $X_2$-$Y_1$, $Y_2$-$X_3$ and $X_4$-$Y_3$ are 0. So, no discharge operation occurs in the display areas $D_1$~$D_3$.

From the above description, it is clear that the global writing voltage difference $V_w$ in the reset period results in the global writing discharge that occur only between the electrode pairs $X_1$-$X_2$, $X_3$-$X_4$ and $Y_1$-$Y_2$, $Y_3$-$Y_4$ in the dark areas $XG_1$, $XG_2$ and $YG_1$, $YG_2$, but not in the display areas $D_1$~$D_3$. Referring to FIG. 5, it is obvious that the priming discharges (PrD) occur in the priming discharge cells (i.e., the dark area) during a reset period. Because the dark areas $XG_1$, $XG_2$ and $YG_1$, $YG_2$ are much narrower than the display areas $D_1$~$D_3$ and covered by a black matrix $B_X$, thus the brightness displayed during the priming discharge process will be shielded and the contrast of the PDP is enhanced.

Moreover, the dark area can selectively be shrunk or narrowed to produce better PDP resolvability.

Yet, the plasma generated during priming discharge can diffuse from priming discharge cells (or dark areas $XG_j$, $YG_j$) to display discharge cells (or display areas $D_j$), because of no rib structure parallel to the scanning and sustaining electrodes in this PDP.

While the invention has been described by way of example and in terms of the preferred embodiment, it is to be understood that the invention is not limited to the disclosed embodiments. On the contrary, it is intended to cover various modifications and similar arrangements as would be apparent to those skilled in the art. Similarly, any process steps described herein may be interchangeable with other steps in order to achieve the same result. Therefore, the scope of the appended claims should be accorded the broadest interpretation so as to encompass all such modifications and similar arrangements, which is defined by the following claims and their equivalents.

What is claimed is:

1. A method of driving a plasma display panel (PDP) said PDP comprising a first substrate and a second substrate supported in spaced relationship to define a discharge space therebetween, a plurality of scanning electrodes ($Y_1$~$Y_n$) and a plurality of sustaining electrodes ($X_1$~$X_n$) formed on said first substrate, configured in a sequence as $X_1$-$X_2$-$Y_1Y_2$-$X_3$-$X_4$ . . . $X_{m-1}$-$X_m$-$Y_{n-1}$-$Y_n$, a plurality of address electrodes formed on said second substrate, perpendicular to said scanning and sustaining electrodes, a stripe rib structure separating said discharge space into a plurality of stripe discharge regions, substantially parallel to said address electrodes; said scanning electrodes ($Y_1$~$Y_n$) are divided into the odd scanning electrodes $Y_{odd}$ and the even scanning electrodes $Y_{even}$, dark areas $G_j$, are defined between every two adjacent sustaining electrodes of said odd sustaining electrodes $X_{odd}$ and said even sustaining electrodes $X_{odd}$, and every two adjacent scanning electrodes of said odd scanning electrodes $Y_{odd}$ and said even scanning electrodes $Y_{even}$, in which no display data is written, and display areas $D_j$, written with display data, are defined between every two adjacent electrodes of said odd scanning electrodes $Y_{odd}$ and said even sustaining electrodes $X_{even}$, and between every two adjacent electrodes of said even scanning electrodes $Y_{even}$ and said odd sustaining electrodes $X_{odd}$, wherein, n, m and j are integers, and $1 \leqq j \leqq n$ and m; when the voltage difference between adjacent said sustaining electrodes ($X_1$~$X_m$) and said scanning electrodes ($Y_1$~$Y_n$) is greater than a firing voltage, said adjacent sustaining electrodes ($X_1$~$X_m$) and scanning electrodes ($Y_1$~$Y_n$) will start a discharge operation, the driving method comprising the following steps:

(a) at the first timing point in a reset period, applying a global writing voltage difference $V_w$ between said adjacent pairs of said even sustaining electrodes $X_{even}$ and odd sustaining electrodes $X_{odd}$, and said adjacent pairs of said even scanning electrodes $Y_{even}$ and odd scanning electrodes $Y_{odd}$, whereas said global writing voltage difference is greater than said firing voltage; and (b) at said first timing point in the reset period, adjusting the voltage difference between said adjacent odd scanning electrodes $Y_{odd}$ and even sustaining electrodes $X_{even}$, and each pair of adjacent even scanning electrodes $Y_{even}$ and odd sustaining electrodes $X_{odd}$ to be less than said firing voltage;

Wherein the priming discharge occurs only in said dark areas $G_j$.

2. The method as claimed in claim 1, wherein a first driving signal is sent to said odd sustaining electrodes $X_{odd}$ and said even scanning electrodes $Y_{even}$, and a second driving signal is sent to said odd scanning electrodes $Y_{odd}$ and said even sustaining electrodes $X_{even}$, and said first driving signal and said second driving signal are added to form a global writing difference, whereby, (1) applying said global writing voltage between said odd sustaining electrodes $X_{odd}$ and said even sustaining electrodes $X_{even}$, and said even scanning electrodes $Y_{even}$ and said odd scanning electrodes $Y_{even}$, and (2) no voltage difference between said odd scanning electrodes $Y_{odd}$ and said even sustaining electrodes $X_{even}$, and said even scanning electrodes $Y_{even}$ and the odd sustaining electrodes $X_{odd}$, thus the priming discharge of reset not occurring in said display areas $D_j$.

3. The method as claimed in claim 1, the driving method further comprising the step of:

(c) at the second timing point following said first timing point in the reset period, applying a first erase voltage difference between said odd sustaining electrodes $X_{odd}$ and said even sustaining electrodes $X_{even}$, and said even scanning electrodes $Y_{even}$ and said odd scanning electrodes $Y_{odd}$.

4. The method as claimed in claim 3, the driving method further comprises the step of:

(d) at the third timing point following said second timing point in the reset period, applying a second erase voltage difference between said odd sustaining electrodes $X_{odd}$ and said even sustaining electrodes $X_{even}$, and said even scanning electrodes $Y_{even}$ and said odd scanning electrodes $Y_{even}$, whereas said first erase voltage and said second erase voltage carry reverse charges.

5. A plasma display panel comprising:

a first substrate and a second substrate supported in spaced relationship to define a discharge space therebetween, said first and second substrates having opposed surfaces facing each other across said discharge space;

a plurality of scanning electrodes an a plurality of sustaining electrodes formed on said first substrate, wherein every two of said scanning electrodes and every two of said sustaining electrodes are alternately arranged on said first substrate, one of said scanning electrodes and adjacent one of said sustain electrodes define a display discharge cell, every two of said scanning electrodes an every two of said sustain electrodes respectively define a priming discharge cell;

a plurality of address electrodes formed on said second substrate, perpendicular to said scanning and sustaining electrodes; and a stripe rib structure separating said discharge space into a plurality of stripe discharge regions, substantially parallel to said address electrodes; wherein every said priming discharge cell performs a priming discharge operation, when every two adjacent said sustaining electrodes and every two adjacent scanning electrodes are respectively applied a global writing voltage difference thereto, at the first timing point in a reset period.

6. The plasma display panel as claimed in claim 5, wherein the spaced region between every two of said scanning electrodes or every two of said sustaining electrodes is narrower than that between one of said scanning electrodes and adjacent one of said sustaining electrodes.

7. The plasma display panel as claimed in claim 5, further comprising a shadowing mask formed on said first substrate, covering every said priming cell.

8. The plasma display panel as claimed in claim 7, wherein said shadowing mask is a black matrix.

9. The plasma display panel as claimed in claim 5, wherein the spaces between every two adjacent sustaining electrodes and every two adjacent scanning electrodes are greater than the space between every two adjacent sustaining electrode and scanning electrode.

* * * * *